US008312847B2

(12) United States Patent
Saito

(10) Patent No.: US 8,312,847 B2
(45) Date of Patent: Nov. 20, 2012

(54) DILUTING FUEL-IN-OIL TREATING APPARATUS OF INTERNAL COMBUSTION ENGINE

(75) Inventor: Yasuhiro Saito, Tokoname (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 339 days.

(21) Appl. No.: 12/414,006

(22) Filed: Mar. 30, 2009

(65) Prior Publication Data

US 2009/0255498 A1 Oct. 15, 2009

(30) Foreign Application Priority Data

Apr. 14, 2008 (JP) ..... 2008-105074

(51) Int. Cl.
*F01P 9/00* (2006.01)

(52) U.S. Cl. ..... 123/41.01; 123/41.33

(58) Field of Classification Search ..... 123/1 A, 123/41.01; 137/13, 14.12; 210/167.04, 416.5, 210/416.4

See application file for complete search history.

(56) References Cited

U.S. PATENT DOCUMENTS

| | | | | |
|---|---|---|---|---|
| 1,459,301 | A * | 6/1923 | Good | 123/196 A |
| 1,769,894 | A * | 7/1930 | Wonning | 110/318 |
| 1,769,897 | A * | 7/1930 | Hans | 123/196 A |
| 4,986,918 | A * | 1/1991 | Breslau et al. | 210/652 |
| 5,329,913 | A * | 7/1994 | Suzuki et al. | 123/573 |
| 6,273,031 | B1 * | 8/2001 | Verdegan et al. | 123/1 A |
| 6,711,893 | B2 * | 3/2004 | Ueda et al. | 60/285 |
| 6,924,460 | B1 * | 8/2005 | Stava | 219/133 |
| 6,972,093 | B2 * | 12/2005 | Partridge et al. | 210/321.6 |
| 7,854,261 | B2 * | 12/2010 | Woie et al. | 166/265 |
| 2001/0011539 | A1 * | 8/2001 | Ito et al. | 123/518 |
| 2001/0022175 | A1 * | 9/2001 | Moren | 123/572 |
| 2005/0103285 | A1 * | 5/2005 | Oda | 123/3 |
| 2005/0103587 | A1 * | 5/2005 | Fischer et al. | 188/297 |
| 2007/0215127 | A1 * | 9/2007 | Dearth et al. | 123/568.15 |
| 2008/0283019 | A1 * | 11/2008 | Arakawa et al. | 123/196 R |
| 2009/0157277 | A1 * | 6/2009 | Pursifull et al. | 701/102 |
| 2009/0165759 | A1 * | 7/2009 | Sengupta et al. | 123/575 |
| 2009/0169965 | A1 * | 7/2009 | Watanabe et al. | 429/34 |

FOREIGN PATENT DOCUMENTS

| | | |
|---|---|---|
| JP | 2004-190513 A | 7/2004 |
| JP | 2004-340056 A | 12/2004 |
| JP | 2005-315172 A | 11/2005 |

OTHER PUBLICATIONS

English language Abstract and translation of JP 2004-190513 A (Jul. 8, 2004).

English language Abstract and translation of JP 2004-340056 A (Dec. 2, 2004).

English language Abstract and translation of JP 2005-315172 A (Nov. 10, 2005).

* cited by examiner

*Primary Examiner* — Noah Kamen
*Assistant Examiner* — Long T Tran
(74) *Attorney, Agent, or Firm* — Greenblum & Bernstein, P.L.C.

(57) ABSTRACT

The present apparatus includes a cross-flow filtration fuel separator having a separation membrane separating by permeation, fuel from lubricating oil flowing in an oil circuit of an internal combustion engine; a vapor-liquid separator separating the fuel separated by the fuel separator, into a gas component and a liquid component; and a fuel collector (canister) collecting the gas component of the fuel separated by the vapor-liquid separator.

12 Claims, 6 Drawing Sheets

DILUTING FUEL-IN-OIL TREATING APPARATUS OF INTERNAL COMBUSTION ENGINE

CROSS-REFERENCE TO RELATED APPLICATIONS

The present application claims priority under 35 U.S.C. §119 of Japanese Patent Application No. 2008-105074, filed on Apr. 14, 2008, the disclosure of which is expressly incorporated by reference herein in its entirety.

BACKGROUND OF THE INVENTION

1. Field of the Invention

The present invention relates to diluting fuel-in-oil treating apparatuses of internal combustion engines and, more particularly, the present invention relates to a diluting fuel-in-oil treating apparatus of an internal combustion engine that can separate the fuel from the lubricating oil of the internal combustion engine while suppressing degradation of the oil, and that enables stable control of an air-fuel ratio at an air intake side.

2. Description of Related Art

Known conventional diluting fuel-in-oil treating apparatuses of internal combustion engines heat lubricating oil and separate the fuel from the lubricating oil by vaporization in order to suppress dilution of the lubricating oil which is caused by mixing of the fuel (e.g., Related Arts 1 and 2). Related Art 1 discloses such technology in which an oil heater is provided on an oil circuit of the internal combustion engine for heating the lubricating oil flowing in the oil circuit in order to separate the fuel by vaporization. Related Art 2 also discloses such technology in which a heater is provided at a bottom portion of an oil pan for heating the lubricating oil in the oil pan in order to separate the fuel by vaporization. In addition, other known conventional diluting fuel-in-oil treating apparatuses use a canister for temporarily adsorbing the vaporized fuel in blow-by gas and return the fuel to the air intake side based on an air-fuel ratio status (e.g., Related Art 3).

[Related Art 1] Japanese Laid-open Patent Publication No. 2004-190513

[Related Art 2] Japanese Laid-open Patent Publication No. 2004-340056

[Related Art 3] Japanese Laid-open Patent Publication No. 2005-315172

In the technologies disclosed in Related Arts 1 and 2, the fuel in the lubricating oil is vaporized using a heater. Since some fuels have a higher boiling point (e.g., 200° C. and so on) depending on the component thereof, heating lubricating oil up to approximately 130° C., which is the maximum temperature at normal use conditions, leaves equal to or more than 30% of the fuel component in the lubricating oil unvaporized. On the other hand, although heating lubricating oil up to approximately 200° C. allows substantially all the fuel in the lubricating oil to vaporize, degradation of the oil is accelerated. In addition, since rapid vaporization of the fuel causes a large amount of the fuel component to be reduced to blow-by gas, stable control of an air-fuel ratio is difficult to achieve at the air intake side. Particularly, the above-described problem is conspicuous with the technology disclosed in Related Art 1 since the heater is used to heat a relatively large amount of the lubricating oil flowing in the oil path that connects the oil pan to a lubricated part in the engine or in a bypass path provided in the oil path. In addition, the above-described problem is extremely conspicuous with the technology disclosed in Related Art 2 since all the oil in the oil pan is heated.

The technology disclosed in Related Art 3 uses a canister for adsorbing the vaporized fuel. The fuel immediately after separation may include both gas and liquid components depending on the temperature thereof. When this happens, the canister cannot adsorb the both components directly.

SUMMARY OF THE INVENTION

The present invention is provided to resolve the above-described problems. A purpose of the present invention is to provide a diluting fuel-in-oil treating apparatus of an internal combustion engine that can separate the fuel from the lubricating oil of the internal combustion engine while suppressing degradation of the oil, and that enables more stable control of an air-fuel ratio at the air intake side.

The present invention is described hereinafter.

1. The diluting fuel-in-oil treating apparatus of the internal combustion engine includes a cross-flow filtration fuel separator having a separation membrane configured to separate by permeation, the fuel from the lubricating oil flowing in an oil circuit of the internal combustion engine; a vapor-liquid separator configured to further separate the fuel separated by the cross-flow filtration fuel separator into a gas component and a liquid component; and a fuel collector configured to collect the gas component of the fuel separated by the vapor-liquid separator.

2. The diluting fuel-in-oil treating apparatus of the internal combustion engine described in above 1 further includes a fuel return path configured to connect a liquid component discharger of the vapor-liquid separator to a fuel tank.

3. The diluting fuel-in-oil treating apparatus of the internal combustion engine described in above 2 further includes an oil path configured to connect an oil container to a lubricated part of the internal combustion engine and constituting the oil circuit; an oil pump provided in the oil path and configured to supply the lubricating oil from the oil container to the lubricated part; a bypass path having one end connected to a downstream side of the oil pump of the oil path and another end connected to an upstream side of the oil pump of the oil path, and further including the cross-filtration fuel separator; and an open/close valve provided in the bypass path and configured to open and close the bypass path based on a temperature of the lubricating oil or a physical quantity of the lubricating oil having a correlation with the temperature.

4. The diluting fuel-in-oil treating apparatus of the internal combustion engine described in above 1 further includes an oil sensor configured to detect the lubricating oil in the fuel separated by the fuel separator; a fuel return path configured to connect a liquid component discharger of the vapor-liquid separator to a fuel tank; a branch path configured to branch from the fuel return path and connected to an oil container; and a solenoid valve provided at a branch portion where the branch path branches from the fuel return path, the solenoid valve configured to switch between an opening and a closing of the branch path and the fuel return path based on the detection result of the oil sensor.

5. According to the diluting fuel-in-oil treating apparatus of the internal combustion engine described in above 4, the oil sensor is provided on an upstream side of the branch portion where the branch path branches from the fuel return path.

6. The diluting fuel-in-oil treating apparatus of the internal combustion engine described in above 1 further includes an oil return path configured to connect a liquid component discharger of the vapor-liquid separator to an oil container.

7. According to the diluting fuel-in-oil treating apparatus of the internal combustion engine described in above 1, the cross-flow filtration fuel separator includes a separator main body having a generally tubular shape and a separation member having the separation membrane. The separation member is provided inside the separator main body and partitions the interior of the separator main body into a first region and a second region. The separator main body includes an oil inlet configured to introduce lubricating oil in the first region, an oil discharger configured to discharge the lubricating oil from the first region, and a fuel discharger configured to discharge the fuel from the second region.

8. According to the diluting fuel-in-oil treating apparatus of the internal combustion engine described in above 7, the separation member is generally tubular and has an axis extending along a direction of an axis of the separator main body.

9. According to the diluting fuel-in-oil treating apparatus of the internal combustion engine described in above 8, the oil inlet is configured to introduce the lubricating oil in a direction tangential to the separator main body.

10. According to the diluting fuel-in-oil treating apparatus of the internal combustion engine described in above 7, the separation member includes the separation membrane having a tubular shape and a plurality of fuel-component permeable fine pores; and a support body configured to support the separation membrane and including a plurality of fine pores. The diameters of the plurality of fine pores of the support body are larger than the plurality of fuel-component permeable fine pores of the separation membrane.

The diluting fuel-in-oil treating apparatus of the internal combustion engine according to the present invention includes the fuel separator having the separation membrane separating by permeation, the fuel from the lubricating oil flowing in the oil circuit of the internal combustion engine. The fuel separated by the fuel separator is further separated into the gas component and the liquid component by the vapor-liquid separator. Then, the gas component of the fuel is collected by the fuel collector. As described above, since the fuel in the lubricating oil is separated by permeation through the separation membrane, the lubricating oil does not have to be heated at a high temperature, and the fuel can be separated while suppressing degradation of the oil. In addition, since reduction of a large amount of the fuel component to blow-by gas is prevented, more stable control of an air-fuel ratio is enabled at the air intake side. Furthermore, since the cross-flow filtration prevents accumulation of foreign objects such as sludge in the lubricating oil on the surface of the separation membrane, drop of the separation efficiency of the separation membrane can be suppressed. Moreover, since only the gas component of the separated fuel is temporarily collected by the fuel collector, the gas component can be returned to the air intake side at a proper timing. Thereby, more stable control of an air-fuel ratio can be enabled at the air intake side. When the diluting fuel-in-oil treating apparatus further includes the fuel return path connecting the liquid component discharger of the vapor-liquid separator to the fuel tank, the liquid component of the fuel discharged from the liquid component discharger of the vapor-liquid separator can be returned to the fuel tank via the fuel return path. Thereby, the fuel economy can be improved. When the diluting fuel-in-oil treating apparatus further includes the oil path, the oil pump, the bypass path, and the open/close valve, the open/close valve opens the bypass path when the temperature of the lubricating oil is low so that a portion of the lubricating oil flowing in the oil path by the action of the oil pump flows into the bypass path. Then, the fuel in the lubricating oil is separated by the fuel separator. Meanwhile, the open/close valve closes the bypass path when the temperature of the lubricating oil is high so that all the lubricating oil flowing in the oil path by the action of the oil pump is supplied to the lubricated part in the internal combustion engine. As described above, when the degree of fuel dilution of the lubricating oil is relatively large at a low temperature, the fuel is separated from a relatively small amount of the lubricating oil branching from the oil path and flowing into the bypass path. Thereby, the fuel can be separated while certainly suppressing degradation of the oil. In addition, since reduction of a large amount of the fuel component to blow-by gas is prevented, more stable control of an air-fuel ratio is enabled at the air intake side. Furthermore, when the degree of fuel dilution of the lubricating oil is relatively small at a high temperature, the lubricating oil flows only in the oil path and does not branch into the bypass path. Thereby, an oil pressure necessary for facilitating the flow of the lubricating oil can be maintained. Moreover, the fuel is separated only when the temperature of the lubricating oil is low so that no oil component is included in the separated fuel. Thereby, all the liquid component of the fuel after vapor-liquid separation can be returned to the fuel tank. When the diluting fuel-in-oil treating apparatus further includes the oil sensor, the fuel return path, the branch path, and a solenoid valve, the solenoid valve opens the fuel return path and closes the branch path when the oil sensor detects no oil in the fuel after separation. Then, the liquid component of the fuel after vapor-liquid separation is returned to the fuel tank via the fuel return path. Meanwhile, when the oil sensor detects any oil in the fuel after separation, the solenoid valve closes the fuel return path and opens the branch path. Then, the liquid component of the fuel after vapor-liquid separation is returned to the oil container. Thereby, the liquid component of the fuel without oil after vapor-liquid separation can be returned to the fuel tank, improving the fuel economy. In addition, the liquid component of the fuel including oil after vapor-liquid separation can be treated without returning the liquid component to the fuel tank. When the oil sensor is provided on the upstream side of the branch portion where the branch path branches from the fuel return path, the oil sensor detects the presence or absence of oil in the liquid component of the fuel after vapor-liquid separation. Thereby, the time-lag between the detection of the oil and the switching of the solenoid valve is reduced or eliminated, and the liquid component of the fuel including oil after vapor-liquid separation is certainly prevented from returning to the fuel tank. In addition, when the diluting fuel-in-oil treating apparatus further includes the oil return path connecting the liquid component discharger of the vapor-liquid separator to the oil container, the liquid component of the fuel discharged from the liquid component discharger of the vapor-liquid separator is returned to the oil container via the oil return path. Thereby, the liquid component of the fuel including oil after vapor-liquid separation can be treated without returning the liquid component to the fuel tank.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

Figure 1:
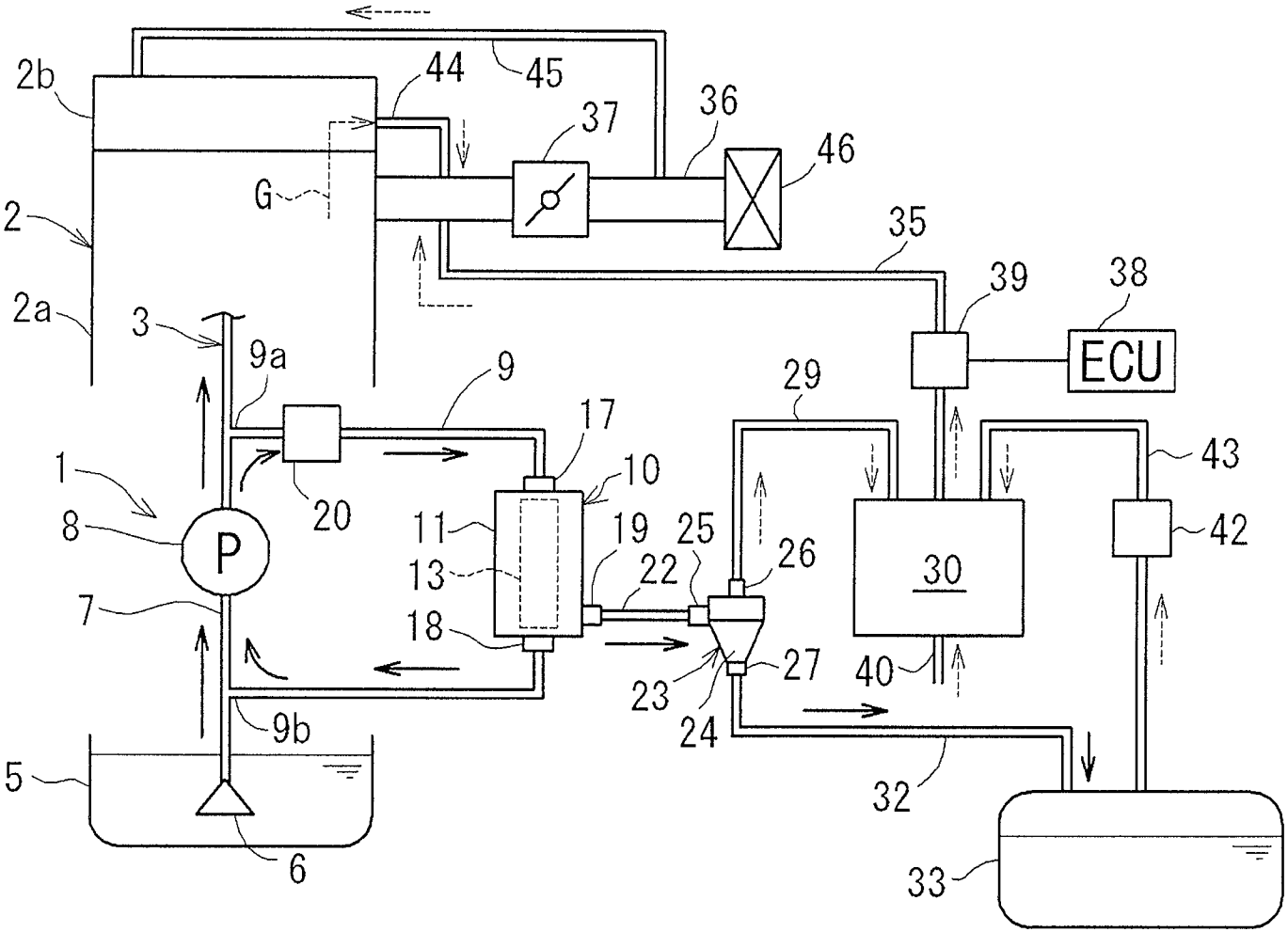
FIG. 1 is an overall circuit diagram schematically illustrating a diluting fuel-in-oil treating apparatus according to a first embodiment.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

1. A Diluting Fuel-in-Oil Treating Apparatus of an Internal Combustion Engine

The present embodiment 1 provides a diluting fuel-in-oil treating apparatus of an internal combustion engine including a fuel separator, a vapor-liquid separator, and a fuel collector, which are described below.

As long as the "fuel separator" above is a cross-flow filtration separator having a separation membrane separating by permeation, the fuel from the lubricating oil flowing in an oil circuit of the internal combustion engine, the structure, the separation method, and so on thereof are not particularly specified. With this fuel separator, when the temperature of the lubricating oil is low (e.g., equal to or lower than 50° C.), the fuel after separation by permeation normally includes no oil since the oil viscosity is high. However, when the temperature of the lubricating oil is high (e.g., a temperature higher than 50° C.), the fuel after separation by permeation includes oil in its liquid state. The "cross-flow filtration" above means filtration in which a portion of flow passes through a filter medium. As long as the "oil circuit of the internal combustion engine" above is a circuit in which lubricating oil flows and circulates, the structure, the shape, the installation manner, and so on thereof are not particularly specified.

The fuel separator may include, for example, a metal or resin separator main body having a tubular shape and a separation member having the separation membrane. The separation member is provided inside the separator main body and partitions the interior of the separator main body into a first region and a second region. The separator main body includes an oil inlet introducing oil in the first region, an oil discharger discharging the oil from the first region, and a fuel discharger discharging the fuel component from the second region. This configuration allows the fuel separator to have a simplified and small-sized structure. With this fuel separator, oil is introduced from the oil inlet into the first region of the separator main body, and a fuel component is separated by permeation through the separation membrane while the oil flows in the first region. Then, the oil is discharged from the first region to the outside of the separator main body through the oil discharger. Meanwhile, the fuel component separated from the oil by permeation through the separation membrane flows in the second region and is discharged from the second region to the outside of the separator main body through the fuel discharger.

In the above configuration, for example, the separation member may have a tubular or columnar shape and have an axis provided along the direction of an axis of the separator main body having a tubular shape. This configuration allows the fuel separator to have a more simplified and smaller-sized structure. In this case, examples of the partition configuration into the first region, the second region, and so on may include: (1) a configuration in which the first region is the inside region of the separation member, and the second region is the outside region of the separation member (Refer to FIG. 2); (2) a configuration in which the first region is the outside region of the separation member, and the second region is the inside region of the separation member (Refer to FIG. 6); and the like. The configuration (2) allows the first region in which a relatively large amount of oil flows to have a large volume.

In the configuration (1), for example, the fuel discharger may be provided for discharging the fuel in the direction tangential to the separator main body. This configuration adds a turning force to the fuel in the second region, and the turn makes the pressure at the axis side smaller than that of the centrifugal side in the second region. Consequently, the pressure difference between the first region and the second region can be increased, enhancing permeability of the fuel through the separation membrane.

In the configuration (2), for example, the oil inlet may be provided for introducing oil in the direction tangential to the separator main body. This configuration adds a turning force to the fuel in the first region, and the turn causes foreign objects such as metal powder having a large relative density in the oil to be collected in the centrifugal direction of the separator main body. Consequently, accumulation of foreign objects on the surface of the separation membrane is further prevented. In this case, it is preferable that the oil discharger is provided for discharging the oil in the direction tangential to the separator main body, so that the oil in the first region is provided with a stronger turning force. In the configuration (2), for example, a collector may be provided at the inner peripheral surface side of the separator main body for collecting foreign objects such as metal powder having a large relative density in the oil. This configuration prevents mixing of foreign objects in the fuel after separation.

The separation member may include, for example, the separation membrane and a support body. The separation membrane is provided with a large number of fuel-component permeable fine pores and has a tubular shape. The support body is provided with a large number of fine pores having larger diameters than those of the fine pores of the separation membrane and supports the separation membrane. Exemplary configurations of the separation member include: (a) a configuration in which the separation membrane having a tubular shape is supported at the inner peripheral side of the support body having a tubular shape (Refer to FIG. 3); (b) a configuration in which the separation membrane having a tubular shape is supported at the outer peripheral side of the support body having a tubular shape (Refer to FIG. 7); (c) a configuration in which the support body having a columnar shape is provided with a plurality of through holes, in each of which a separation membrane is supported (Refer to FIG. 9); and the like. The shape, the material, the number of pieces, and so on of the separation member, the support body, and the separation membrane are selected properly according to the flow rate and so on of the oil to be separated. The thickness of the separation membrane may be, for example, 1-1000 μm (preferably, 10-20 μm). Examples of the material of the separation member, the support body, and the separation membrane include ceramic, resin, rubber, and so on.

The fuel separator may further include, for example, a heater heating the separation member (e.g., a heater or the like provided on the surface side or inside the separation member). Thereby, separation of fuel component from oil can be further accelerated.

As long as the "vapor-liquid separator" above separates the fuel separated by the fuel separator into the gas component and the liquid component, the structure, the separation method, and so on thereof are not particularly specified. The vapor-liquid separator may include, for example, a fuel inlet, a gas component discharger, and a liquid component discharger in the main body thereof, the main body being provided with a separation chamber. The fuel inlet introduces fuel into the separation chamber of the main body. The gas component discharger discharges the gas component of the fuel separated in the separation chamber to the outside of the main body. The liquid component discharger discharges the liquid component of the fuel separated in the separation chamber to the outside of the main body. Examples of the vapor-liquid separator include a centrifugal type, a chamber type, and so on.

As long as the "fuel collector" above collects the gas component of the fuel separated by the vapor-liquid separator, the structure, the collection method, and so on thereof are not particularly specified. Examples of the fuel collector include a canister having an adsorbent such as granular activated carbon filled therein, a canister configured of an adsorbent honeycomb structure such as activated carbon, and so on.

Exemplary configurations of the diluting fuel-in-oil treating apparatus of the internal combustion engine include configurations (1), (2), and (3), which are described below.

(1) A configuration in which a fuel return path connecting the liquid component discharger of the vapor-liquid separator to the fuel tank is further provided (Refer to FIG. 1).

Figure 4:
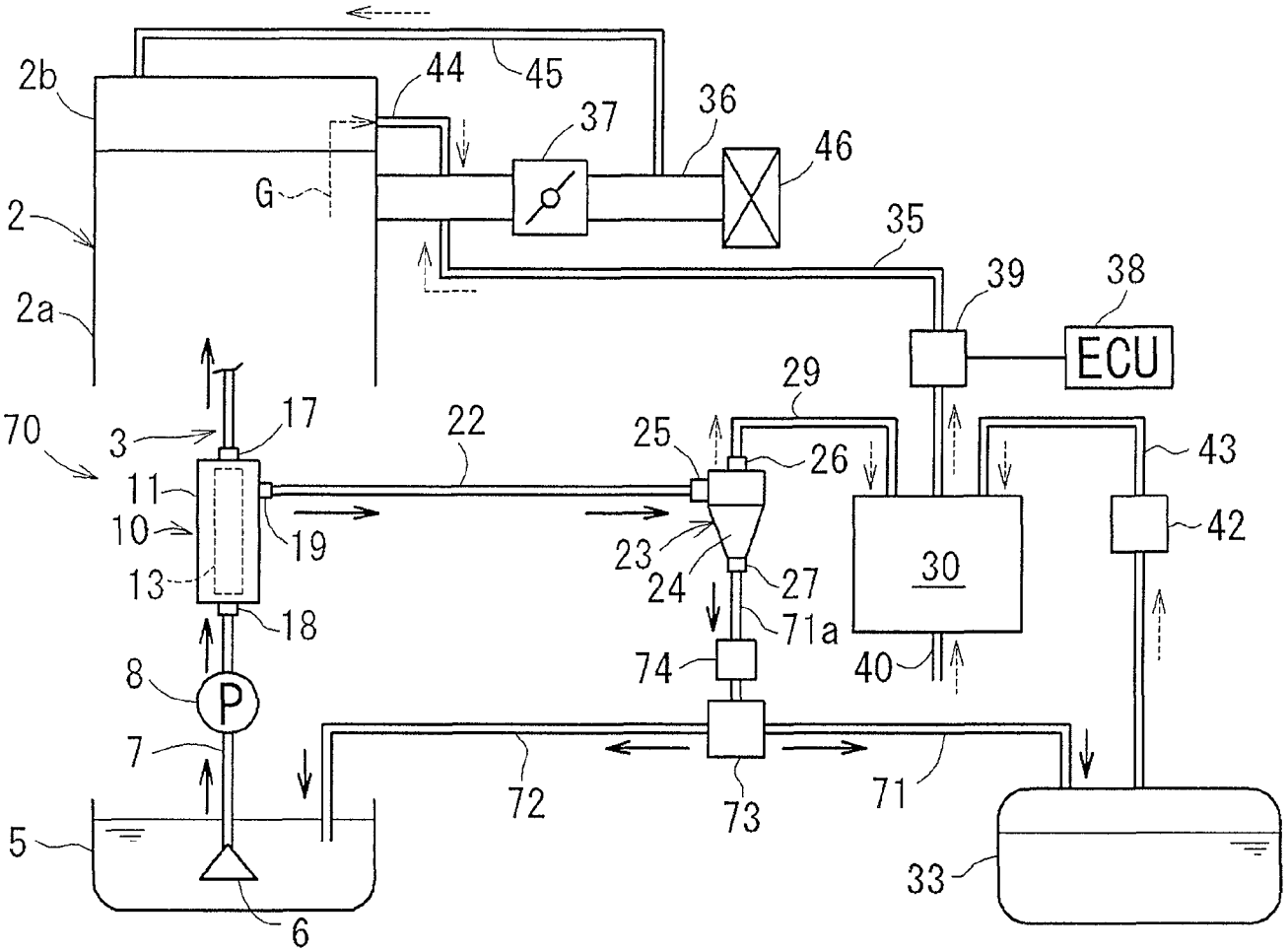
FIG. 4 is an overall circuit diagram schematically illustrating a diluting fuel-in-oil treating apparatus according to a second embodiment.

(2) A configuration in which an oil sensor, a fuel return path, a branch path, and a solenoid valve are further provided, the oil sensor detecting oil in the fuel separated by the fuel separator, the fuel return path connecting the liquid component discharger of the vapor-liquid separator to the fuel tank, the branch path branching from the fuel return path and being connected to the oil container; and a solenoid valve being provided at a branch portion where the branch path branches from the fuel return path and switching between opening and closing of the branch path and the fuel return path based on the detection result of the oil sensor (Refer to FIG. 4).

Figure 5:
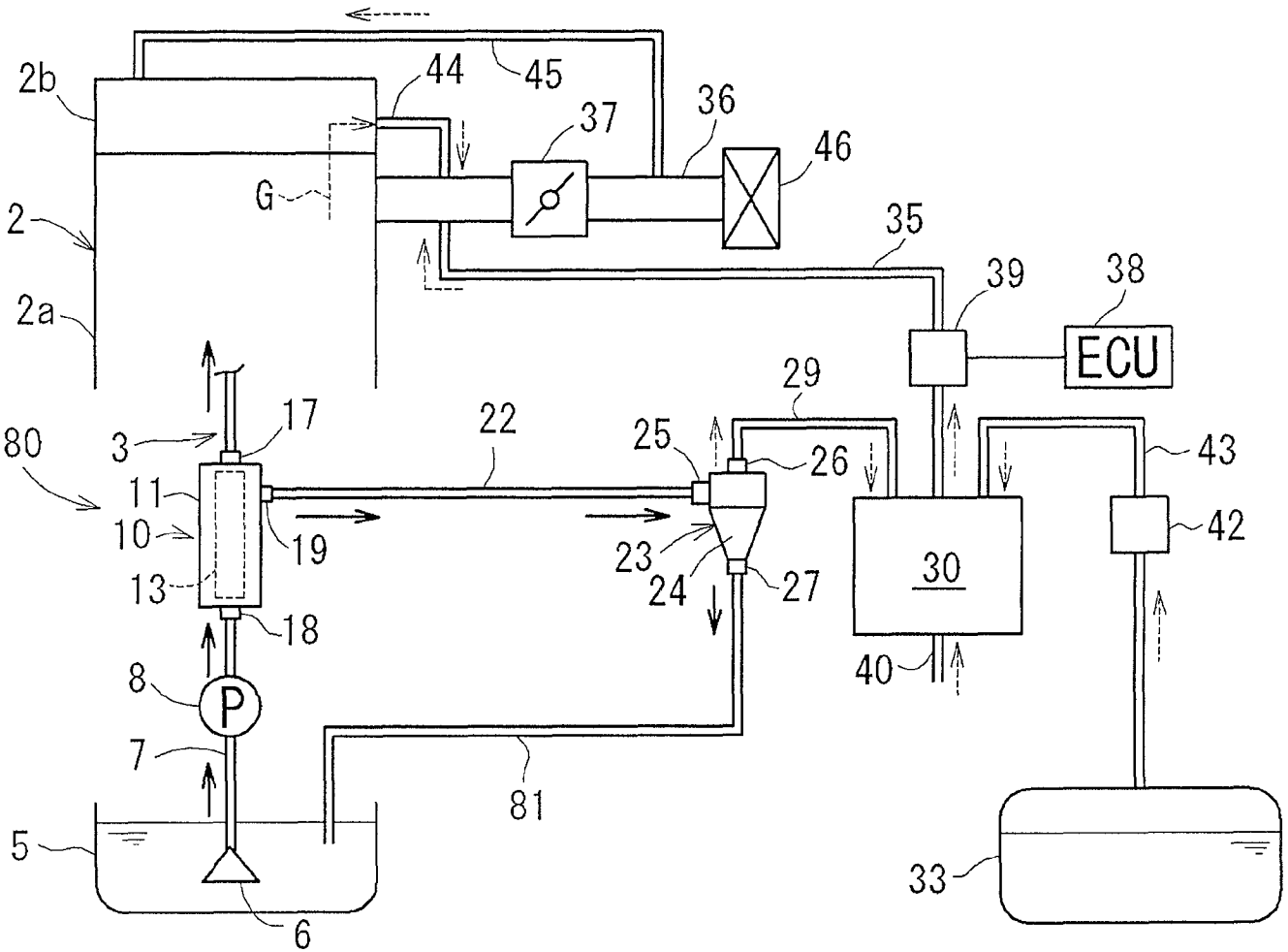
FIG. 5 is an overall circuit diagram schematically illustrating a diluting fuel-in-oil treating apparatus according to a third embodiment.

(3) A configuration in which an oil return path connecting the liquid component discharger of the vapor-liquid separator to the oil container is further provided (Refer to FIG. 5).

In the configurations (1) to (3), examples of the oil container may include an oil pan that is provided at the lower portion of the main body of the internal combustion engine, an oil tank that is provided separately from the main body of the internal combustion engine, and so on. As long as the "fuel tank" above contains fuel, the structure, the shape, and the material thereof are not particularly specified. Examples of the oil path include any combination of one or more of the following: a pipe, a path provided in the main body or the mechanism unit of the internal combustion engine, space, and so on. In addition, examples of the lubricated parts in the internal combustion engine include a bearing, a piston, a camshaft, valve system, and so on.

In the configuration (1), for example, an oil path, an oil pump, a bypass path, and an open/close valve may further be provided. The oil path connects the oil container to the lubricated parts of the internal combustion engine and constitutes an oil circuit. The oil pump is provided in the oil path for supplying lubricating oil from the oil container to the lubricated parts. The bypass path has one end side thereof connected to the downstream side of the oil pump of the oil path and the other end side thereof connected to the upstream side of the oil pump of the oil path, and further includes the fuel separator. The open/close valve is provided in the bypass path for opening and closing the bypass path based on the temperature of the lubricating oil or the physical quantity that has a correlation with the temperature.

Examples of the oil pump include a trochoid pump, an internal gear pump, an external gear pump, an inner gear pump, and so on. In addition, the oil pump may be operated, for example, by a driving force of the internal combustion engine or by a drive source other than the internal combustion engine.

Examples of the bypass path include any combination of one or more of the following: a pipe, a path provided in the main body or the mechanism unit of the internal combustion engine, space, and so on. Examples of the connection configuration of the other end side of the bypass path include: (a) a configuration in which the other end side of the bypass path is connected to the upstream side of the oil pump in the oil path (Refer to FIG. 1); and (b) a configuration in which the other end side of the bypass path is connected to the oil container (Refer to FIG. 10). In the configuration (a), when the temperature of the lubricating oil is low, the lubricating oil flowing in the bypass path with a certain amount of force after the fuel is separated therefrom is returned to the upstream side of the oil pump of the oil path. Thereby, friction in the internal combustion engine can be reduced. In the configuration (b), when the temperature of the lubricating oil is low, the lubricating oil is returned to the oil container after the fuel was separated from the lubricating oil and is mixed into a large amount of the lubricating oil in the oil container from which the fuel has not yet been separated. Thereby, lubricating oil including a relatively large amount of fuel component flows in the oil path, improving the fuel separation efficiency.

Examples of the physical quantity include the pressure, the viscosity, and the fuel dilution of the lubricating oil, the temperature of the cooling water that cools the lubricating oil, the temperature of the components of the internal combustion engine, and so on. According to the present embodiment, for example, the pressure of the lubricating oil flowing in the oil path is approximately 400 kPa when the temperature thereof is approximately 50° C., and the pressure thereof is approximately 200 kPa when the temperature thereof is approximately 130° C. In short, the pressure of the lubricating oil has a constant correlation with the temperature thereof of the lubricating oil.

The open/close valve may be provided, for example, on the downstream side of the fuel separator of the bypass path. However, it is preferable that the open/close valve is provided on the upstream side of the fuel separator of the bypass path. The reason for this is to minimize or substantially eliminate residual oil in the bypass path in its closed state so that the necessary amount of lubricating oil is easily ensured.

Examples of the open/close valve include: (a) a valve body that is urged by an elastic body such as a spring and the like to the position for closing the bypass path and that is displaced to open the bypass path by the pressure of the lubricating oil flowing into the bypass path when the pressure of the lubricating oil exceeds a predetermined setting value (e.g., any numerical value from 375 to 425 kPa); (b) a thermostat that closes the bypass path when the temperature of the lubricating oil flowing into the bypass path exceeds a predetermined setting value (e.g., any numerical value from 40° C. to 60° C.) and opens the bypass path when the temperature is equal to or lower than the predetermined setting value; (c) a solenoid valve that is controlled to open or close based on the detection result of a detection sensor that detects the temperature of the lubricating oil; and (d) a solenoid valve that is controlled to open or close based on the detection result of a detection sensor that detects the physical quantity. In terms of simplified configuration, the example (a) is preferable. In addition, in terms of more accurate control by temperature, the examples (b) and (c) are preferable.

In the configuration (2), examples of the oil sensor include a viscosity sensor, a dilution sensor, a concentration sensor, and so on. In the configuration (2), for example, the oil sensor may be provided between the fuel discharger of the fuel separator and the fuel inlet of the vapor-liquid separator. However, it is preferable that the oil sensor is provided on the upstream side of the branch portion where the branch path branches from the fuel return path. In the configurations (2) and (3), for example, the fuel separator may be provided on either the downstream side or the upstream side of the oil pump.

EMBODIMENT

First to third embodiments of the present invention will be described in detail with reference to the drawings. In the first to third embodiments, a direct fuel-injection engine is mentioned as an example of an "internal combustion engine" according to the present invention, the direct fuel-injection engine being provided with a fuel injection valve in a combustion chamber thereof and directly injecting fuel onto an inner peripheral surface of a cylinder.

First Embodiment

(1) A Configuration of a Diluting Fuel-in-Oil Treating Apparatus

A diluting fuel-in-oil treating apparatus 1 according to the first embodiment is provided midway through an oil circuit 3 of an engine 2 as shown FIG. 1. The engine 2 is provided with an oil pan 5 (mentioned as an example of an "oil container" according to the present invention) at a lower portion of a main body 2*a* thereof for containing lubricating oil. The oil pan 5 is provided with an oil strainer 6 therein. The oil strainer 6 and the lubricated parts of the engine 2 (omitted in the drawings) are connected via an oil path 7 that constitutes the oil circuit 3. An oil pump 8 is provided midway through the oil path 7 for pressure feeding the lubricating oil from the oil pan 5 to each of the lubricated parts by the driving force of the engine 2.

A bypass path 9 has one end side 9*a* (an inlet end side) thereof connected to a downstream side of the oil pump 8 of the oil path 7. In addition, the bypass path 9 has another end side 9*b* (an outlet end side) thereof connected to an upstream side of the oil pump 8 of the oil path 7. A fuel separator 10 is provided midway through the bypass path 9 for separating the fuel from the lubricating oil flowing in the bypass path 9.

Figure 2:
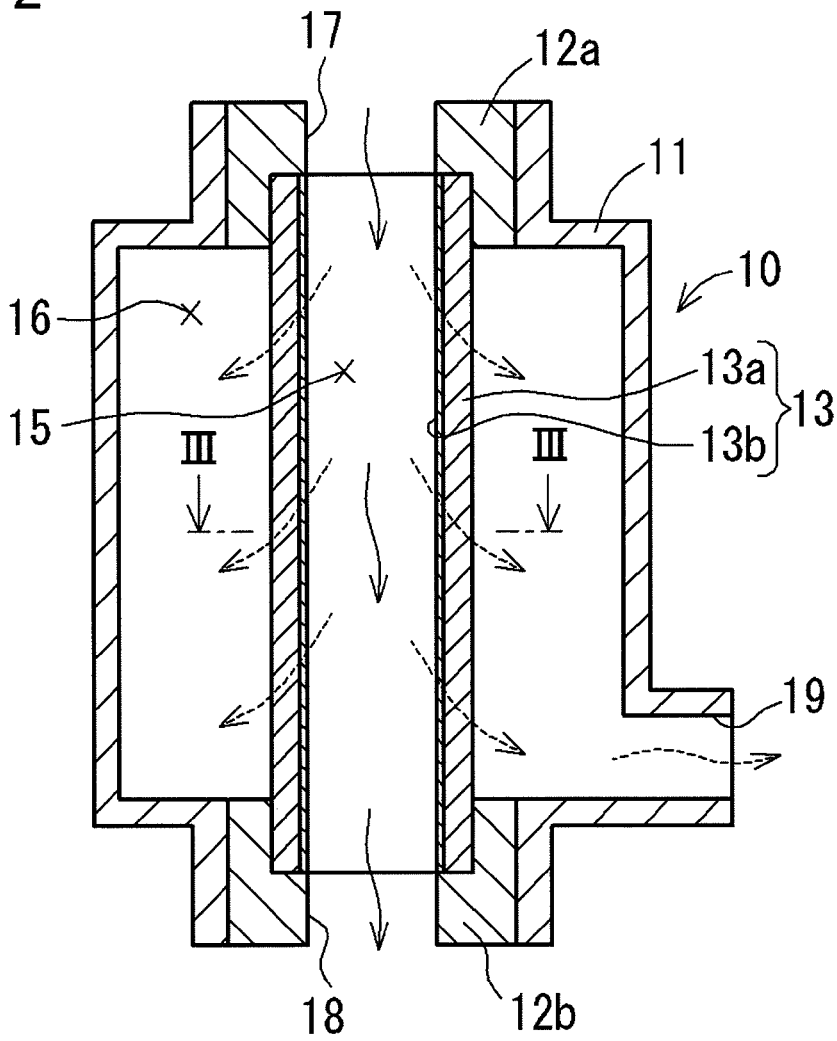
FIG. 2 is a longitudinal sectional view of a fuel separator according to the first embodiment.

As shown in FIG. 2, the fuel separator 10 is provided with a metal separator main body 11 having a tubular shape. The separator main body 11 is provided with ring members 12*a* and 12*b* at both axial end sides thereof, the ring members 12*a* and 12*b* having a stepped opening. A ceramic filter 13 having a cylindrical shape is supported at both end sides thereof by each of the ring members 12*a* and 12*b*. The ceramic filter 13 is provided inside the separator main body 11 along an axis of the separator main body 11. The ceramic filter 13 partitions the interior of the separator main body 11 into a first region 15 that is an inner side of the ceramic filter 13 and a second region 16 that is an external side of the ceramic filter 13. An oil inlet 17 for introducing lubricating oil from the outside into the first region 15 is constituted by the inner peripheral side of the ring members 12*a* at one side. An oil discharger 18 for discharging lubricating oil from the first region 15 to the outside is constituted by the inner peripheral side of the ring member 12*b* at the other side. A fuel discharger 19 is provided at an outer peripheral side of the separator main body 11 for discharging a fuel component to the outside, the fuel component flowing in the second region 16 after separation by permeation through the ceramic filter 13.

Figure 3:
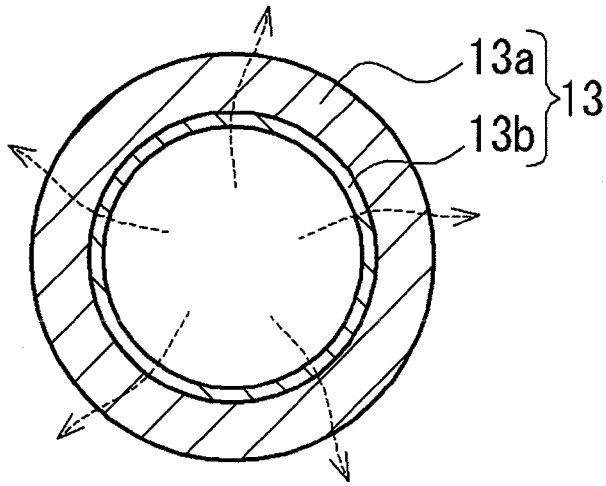
FIG. 3 is a cross-sectional view of the fuel separator taken along a line III-III in FIG. 2.

As shown in FIG. 3, the ceramic filter 13 is two-layered, having a support body 13*a* and a separation membrane 13*b*. The support body 13*a* having a tubular shape is provided with a large number of fine pores. The separation membrane 13*b* having a cylindrical shape is supported by an inner peripheral surface of the support body 13*a* and is provided with a large number of fuel-component permeable fine pores. The thickness of the support body 13*a* is approximately 2 mm, and the thickness of the separation membrane 13*b* is approximately 10 μm. The average pore diameter of the support body 13*a* is approximately 10 μm, and the average pore diameter of the separation membrane 13*b* is approximately 20 nm.

Fuel used in an engine, such as gasoline, has a molecular structure having approximately 4 to 13 carbon atoms for each molecule. Oil has a molecular structure having equal to or more than 25 carbon atoms for each molecule. Due to such difference in the molecular structures, the diameter of the fuel molecule is smaller than that of the fine pores of the separation membrane 13*b*, and the diameter of the oil molecule is larger than that of the fine pores of the separation membrane 13*b*. Thereby, the fuel mixed in the oil can be separated by the ceramic filter 13. In addition, since the pore diameter of the support body 13*a* is extremely large when compared to that of the separation membrane 13*b*, the fuel that has passed through the separation membrane 13*b* can pass through the support body 13*a* with smaller resistance than that of passing through the separation membrane 13*b*.

As shown in FIG. 1, a known open/close valve 20 is provided on the upstream side of the fuel separator 10 of the bypass path 9 for opening and closing the bypass path 9 according to the pressure of the lubricating oil (mentioned as an example of a "physical quantity having a correlation with a temperature" according to the present invention) flowing in the bypass path 9. The open/close valve 20 is provided with a valve body (omitted in the drawing) that is urged by an elastic body such as a spring (omitted in the drawing) to a position for closing the bypass path 9. The valve body is displaced to open the bypass path 9 by the pressure of the lubricating oil flowing into the bypass path 9 when the pressure of the lubricating oil exceeds a predetermined setting value (e.g., 400 kPa). A portion of the lubricating oil flowing in the oil path 7 by the action of the oil pump 8 flows in the bypass path 9 that is opened by the open/close valve 20.

The fuel discharger 19 of the fuel separator 10 is connected to a known centrifugal vapor-liquid separator 23 via a path 22. The vapor-liquid separator 23 is provided with a main body 24 having a substantially cylindrical shape. The main body 24 is provided on a wall of the upper side thereof with a fuel inlet 25 to which one end side of the path 22 is connected. The fuel inlet 25 introduces the fuel that is discharged from the fuel discharger 19 of the fuel separator 10 into the main body 24 in the tangential direction. The main body 24 is provided with a gas component discharger 26 on a ceiling wall thereof for discharging to the outside, the gas component of the fuel centrifugally separated in the main body 24. The main body 24 is provided with a liquid component discharger 27 at the lower portion thereof for discharging a liquid component of the fuel centrifugally separated in the main body 24.

The gas component discharger 26 of the vapor-liquid separator 23 is connected to a canister 30 (mentioned as an example of a "fuel collector" according to the present invention) via a path 29, the canister having a granular activated carbon filled therein. The gas component centrifugally separated by the vapor-liquid separator 23 is adsorbed in the canister 30 via the path 29 and is temporarily collected. The liquid component discharger 27 of the vapor-liquid separator 23 is connected to a fuel tank 33 via a fuel return path 32. The liquid component of the fuel centrifugally separated by the vapor-liquid separator 23 is returned to the fuel tank 33 via the fuel return path 32.

The canister 30 is connected to the downstream side of a throttle valve 37 of an air intake pipe 36 via a path 35. A purge solenoid valve 39 that is controlled by an engine control unit 38 (ECU) to open and close the path 35 is provided midway through the path 35. When the solenoid valve 39 opens the path 35, air is introduced from a path 40. Thereby, the gas component of the fuel temporarily collected in the canister 30 is introduced into the air intake pipe 36 and is burned. The fuel tank 33 is connected to the canister 30 via a path 43 midway through which a known non-return valve 42 is provided. The gas component of the fuel produced in the fuel tank 33 is adsorbed in the canister 30 via the path 43 and is temporarily collected.

The engine control unit 38 controls the purge solenoid valve 39, the ignition timing of an ignition plug, the amount of the fuel injected from a fuel injection valve, the injection timing, and so on based on the input from various sensors. The downstream side of the throttle valve 37 of the air intake pipe 36 is connected to the interior of a head cover 2*b* via a path 44. A blow-by gas G (shown by the arrow of a dotted line in FIG. 1) produced in the engine main body 2*a* is refluxed to the air intake pipe 36 via the path 44. The upstream side of the throttle valve 37 of the air intake pipe 36 is connected to the interior of the head cover 2*b* via a path 45 via which fresh air is introduced into the head cover 2*b*. In addition, an air cleaner 46 is provided on the upstream side of the throttle valve 37 of the air intake pipe 36.

(2) A Function of a Diluting Fuel-in-Oil Treating Apparatus

Hereinafter, the function of the diluting fuel-in-oil treating apparatus 1 having the above configuration will be described. In the present embodiment, since a direct fuel-injection engine 2 is employed, the fuel that attaches to the inner peripheral surface of the cylinder is mixed into the lubricating oil. Therefore, the lubricating oil in the oil pan 5 is easily diluted. Particularly, when the temperature of the lubricating oil is low (e.g., equal to or lower than 50° C.), little of the fuel in the lubricating oil is vaporized, and therefore the amount of the diluting fuel is relatively large. Meanwhile, when the temperature of the lubricating oil is high (e.g., 130° C.), most of the fuel in the lubricating oil is vaporized, and therefore the amount of the diluting fuel in the lubricating oil is relatively small.

When the temperature of the lubricating oil is low (e.g., equal to or lower than 50° C.), and the amount of the diluting fuel is relatively large, the open/close valve 20 opens the bypass path 9, as shown by the arrow of a solid line in FIG. 1, a large portion of the lubricating oil flowing in the oil path 7 by the action of the oil pump 8 is supplied to each of the lubricated parts in the engine 2. In addition, a portion of the lubricating oil flowing in the oil path 7 flows into the bypass path 9, and the fuel separator 10 separates the fuel in the lubricating oil. At this time, as shown by the arrow of a solid line in FIG. 2, the fuel component is separated from the lubricating oil introduced from the oil inlet 17 into the first region 15, by permeation through the ceramic filter 13, and the lubricating oil is discharged from the oil discharger 18 to the outside. Then, the discharged lubricating oil flows in the bypass path 9 and returns to the oil path 7. Meanwhile, as shown by the arrow of a dotted line in FIG. 2, the fuel separated from the lubricating oil by permeation through the ceramic filter 13 reaches the second region 16 and is discharged from the fuel discharger 19 to the outside of the separator main body 11. Then, the discharged fuel is introduced into the vapor-liquid separator 23 via the path 22 and is centrifugally separated into the gas component and the liquid component. In the first embodiment, when the temperature of the lubricating oil is low (e.g., equal to or lower than 50° C.), no oil is included in the fuel after centrifugal separation.

The gas component of the fuel centrifugally separated by the vapor-liquid separator 23 is adsorbed in the canister 30 via the path 29 and is temporarily collected. Then, the engine control unit 38 switches the purge solenoid valve 39 at a proper timing. The gas component of the fuel, which has been collected by the canister 30, is introduced to the air intake pipe 36 via the path 35 opened by the solenoid valve 39 and is burned. In addition, the liquid component of the fuel centrifugally separated by the vapor-liquid separator 23 is returned to the fuel tank 33 via the fuel return path 32.

Meanwhile, when the temperature of the lubricating oil is high (e.g., 130° C.) and the amount of the diluting fuel in the lubricating oil is relatively small, the open/close valve 20 closes the bypass path 9, and all of the lubricating oil flowing in the oil path 7 by the action of the oil pump 8 is supplied to each of the lubricated parts in the engine 2. In addition, a large portion of the fuel component in the lubricating oil in the oil pan 5 is vaporized and is mixed into the blow-by gas G produced in the engine main body 2*a*. The mixed gas is refluxed to the air intake pipe 36 via the path 44.

(3) An Effect of the Embodiment

According to the first embodiment, the fuel is separated from the lubricating oil flowing in the oil circuit 3 of the engine 2 by permeation through the separation membrane 13*b* of the fuel separator 10. The fuel separated by the fuel separator 10 is further separated into the gas component and the liquid component by the vapor-liquid separator 23, and then the gas component of the fuel is collected by the canister 30. As described above, since the fuel in the lubricating oil is separated by permeation through the separation membrane 13*b*, the lubricating oil does not have to be heated at a high temperature, and the fuel can be separated while suppressing degradation of the oil. In addition, since reduction of a large amount of the fuel component to blow-by gas is prevented, more stable control of an air-fuel ratio is enabled at the air intake side. Furthermore, since the cross-flow filtration prevents accumulation of foreign objects such as sludge in the lubricating oil on the surface of the separation membrane 13*b*, the separation efficiency of the separation membrane 13*b* can be prevented from deteriorating. Moreover, since only the gas component of the separated fuel is temporarily collected by the canister 30, the gas component can be returned to the air intake side at a proper timing. Thereby, more stable control of an air-fuel ratio is enabled at the air intake side.

In the first embodiment, since the diluting fuel-in-oil treating apparatus 1 is further provided with the fuel return path 32 connecting the liquid component discharger of the vapor-liquid separator 23 to the fuel tank 33, the liquid component of the fuel discharged from the liquid component discharger 27 of the vapor-liquid separator 23 can be returned to the fuel tank 33 via the fuel return path 32. Thereby, the fuel economy can be improved.

In the first embodiment, the diluting fuel-in-oil treating apparatus 1 is further provided with the oil path 7, the oil pump 8, the bypass path 9, and the open/close valve 20. The open/close valve 20 opens the bypass path 9 when the oil temperature is low so that a portion of the lubricating oil flowing in the oil path 7 by the action of the oil pump 8 flows into the bypass path 9. Then, the fuel in the lubricating oil is separated by the fuel separator 10. Meanwhile, the open/close valve 20 closes the bypass path 9 when the oil temperature is high so that all the lubricating oil flowing in the oil path 7 by the action of the oil pump 8 is supplied to the lubricated parts in the engine 2. As described above, when the degree of fuel dilution of the lubricating oil is relatively large at a low temperature, the fuel is separated from a relatively small amount of the lubricating oil branching from the oil path 7 and flowing in the bypass path 9. Thereby, the fuel can be separated while certainly suppressing degradation of the oil. In addition, since reduction of a large amount of the fuel component to blow-by gas is prevented, more stable control of an air-fuel ratio can be enabled at the air intake side. Furthermore, since the lubricating oil does not separately flow into the bypass path 9 and flows only in the oil path 7 when the degree of fuel dilution of the lubricating oil is relatively small at a high temperature, an oil pressure necessary for facilitating the flow of the lubricating oil can be maintained. Moreover, since the fuel is separated only when the temperature of the lubricating oil is low, no oil component is included in the separated fuel, allowing all the liquid component of the fuel after vapor-liquid separation to be returned to the fuel tank 33.

In the first embodiment, the bypass path 9 has the other end side (the outlet end side) thereof connected to the upstream side of the oil pump 8 of the oil path 7 so that, when the temperature of the lubricating oil is low, the lubricating oil flowing in the bypass path 9 with a certain amount of force after the fuel is separated therefrom is returned to the upstream side of the oil pump 8 of the oil path 7. Thereby, friction in the engine 2 can be reduced.

In addition, in the first embodiment, the open/close valve 20 is provided on the upstream side of the fuel separator 10 of the bypass path 9. Thereby, the residual oil in the bypass path 9 in its closed state can be minimized or substantially eliminated, allowing the amount of the lubricating oil necessary at a high temperature to be more easily ensured.

Second Embodiment

Hereinafter, a diluting fuel-in-oil treating apparatus according to a second embodiment will be described. For the diluting fuel-in-oil treating apparatus of the second embodiment, a detailed description of its construction portions substantially similar to those of the diluting fuel-in-oil treating apparatus 1 of the first embodiment is omitted herein by adding thereto the same reference numerals used in the first embodiment, and differences therebetween will be described.

(1) A Configuration of a Diluting Fuel-in-Oil Treating Apparatus

As shown in FIG. 4, a diluting fuel-in-oil treating apparatus 70 of the second embodiment is provided midway through an oil circuit 3 of an engine 2. A fuel separator 10 is provided on the downstream side of an oil pump 8 of an oil path 7, which constitutes the oil circuit 3. The fuel separator 10 separates the fuel in the lubricating oil flowing in the oil path 7. The fuel separator 10 includes a separator main body 11 provided with an oil inlet 17, an oil discharger 18, and a fuel discharger 19, and a ceramic filter 13.

The fuel discharger 19 of the fuel separator 10 is connected to a known centrifugal vapor-liquid separator 23 via a path 22. The vapor-liquid separator 23 includes a main body 24 provided with a fuel inlet 25, a gas component discharger 26, and a liquid component discharger 27.

The liquid component discharger 27 of the vapor-liquid separator 23 is connected to a fuel tank 33 via a fuel return path 71. One end side of a branch path 72 is connected to a midway point of the fuel return path 71 via a solenoid valve 73. Another end side of the branch path 72 is connected into an oil pan 5. An oil sensor 74 for detecting the oil in the liquid component of the fuel separated by the fuel separator 10 is provided on the upstream side of a branch connecting portion at which the branch path 72 branches from the fuel return path 71. An engine control unit 38 controls the solenoid valve 73 for switching between the open and close states of the branch path 72 and the fuel return path 71 based on the detection result of the oil sensor 74. When the solenoid valve 73 opens the fuel return path 71 and closes the branch path 72, the liquid component of the fuel centrifugally separated by the vapor-liquid separator 23 returns to the fuel tank 33 via the fuel return path 71. When the solenoid valve 73 closes the fuel return path 71 and opens the branch path 72, the liquid component of the fuel centrifugally separated by the vapor-liquid separator 23 returns to the oil pan 5 via the branch path 72. In the second embodiment, a viscosity sensor is employed as the oil sensor 74 for detecting the presence or absence of the oil based on the difference in the viscosity of the liquid component of the fuel.

(2) A Function of a Diluting Fuel-in-Oil Treating Apparatus

Hereinafter, the function of the diluting fuel-in-oil treating apparatus 70 having the above configuration will be described. As shown by the arrow of a solid line in FIG. 4, the fuel separator 10 separates by permeation, the fuel from the lubricating oil flowing in the oil path 7 by the action of the oil pump 8, and the lubricating oil from which the fuel is separated is supplied to each of the lubricated parts of the engine 2. The fuel separated from the lubricating oil by permeation by the fuel separator 10 is introduced into the vapor-liquid separator 23 via the path 22 and is centrifugally separated into the gas component and the liquid component. In the second embodiment, when the temperature of the lubricating oil is low (e.g., equal to or lower than 50° C.), little oil is included in the fuel after separation by permeation. When the temperature of the lubricating oil is high (e.g., higher than 50° C.), oil is included in the fuel after separation by permeation.

The gas component of the fuel centrifugally separated by the vapor-liquid separator 23 is temporarily collected by a canister 30 via a path 29. Then, the gas component is introduced to an air intake pipe 36 at a proper timing and is burned. The oil sensor 74 detects the presence or absence of the oil in the liquid component of the fuel centrifugally separated by the vapor-liquid separator 23 when the liquid component of the fuel flows in an upstream side 71*a* of the fuel return path 71. When no oil is detected by the oil sensor 74, the solenoid valve 73 opens the fuel return path 71 and closes the branch path 72. The liquid component of the fuel after centrifugal separation is returned to the fuel tank 33 via the fuel return path 71. Meanwhile, when any oil is detected by the oil sensor 74, the solenoid valve 73 closes the fuel return path 71 and opens the branch path 72. Then, the liquid component of the fuel after centrifugal separation is returned to the oil pan 5 via the branch path 72.

(3) An Effect of the Embodiment

According to the second embodiment, functions and effects substantially similar to those of the first embodiment can be achieved. In addition, the diluting fuel-in-oil treating apparatus 70 is further provided with the fuel return path 71, the branch path 72, the solenoid valve 73, and the oil sensor 74 so that the fuel economy can be improved by returning the liquid component of the fuel without oil after vapor-liquid separation to the fuel tank 33. In addition, the liquid component of the fuel including oil after vapor-liquid separation can be treated without returning the liquid component to the fuel tank 33.

Furthermore, in the second embodiment, since the oil sensor 74 is provided in the vicinity of the upstream side of the solenoid valve 73 of the fuel return path 71, the time-lag between the detection of the oil and the switching of the solenoid valve 73 can be reduced or eliminated, and the liquid component of the fuel including oil after vapor-liquid separation can be certainly prevented from returning to the fuel tank 33.

Third Embodiment

Hereinafter, a diluting fuel-in-oil treating apparatus according to a third embodiment will be described. For the diluting fuel-in-oil treating apparatus of the third embodiment, a detailed description of its construction portions substantially similar to those of the diluting fuel-in-oil treating apparatus 1 of the first embodiment is omitted herein by adding the same reference numerals used in the first embodiment, and differences therebetween will be described.

(1) A Configuration of a Diluting Fuel-in-Oil Treating Apparatus

As shown in FIG. 5, a diluting fuel-in-oil treating apparatus 80 of the third embodiment is provided midway through an oil circuit 3 of an engine 2. A fuel separator 10 is provided on the downstream side of an oil pump 8 of an oil path 7, which constitutes the oil circuit 3. The fuel separator 10 separates the fuel in the lubricating oil flowing in the oil path 7. The fuel separator 10 includes separator main body 11 provided with an oil inlet 17, an oil discharger 18, and a fuel discharger 19, and a ceramic filter 13.

The fuel discharger 19 of the fuel separator 10 is connected to a known centrifugal vapor-liquid separator 23 via a path 22. The vapor-liquid separator 23 includes a main body 24 provided with a fuel inlet 25, a gas component discharger 26, and a liquid component discharger 27. The liquid component discharger 27 of the vapor-liquid separator 23 is connected to an oil pan 5 via an oil return path 81.

(2) A Function of a Diluting Fuel-in-Oil Treating Apparatus

Hereinafter, the function of the diluting fuel-in-oil treating apparatus 80 having the above configuration will be described. As shown by the arrow of a solid line in FIG. 5, the fuel separator 10 separates by permeation, the fuel from the lubricating oil flowing in the oil path 7 by the action of the oil pump 8, and the lubricating oil from which the fuel is separated is supplied to each of the lubricated parts of the engine 2. The fuel separated from the lubricating oil by permeation by the fuel separator 10 is introduced into the vapor-liquid separator 23 via the path 22 and is centrifugally separated into the gas component and the liquid component. In the third embodiment, when the temperature of the lubricating oil is low (e.g., equal to or lower than 50° C.), little oil is included in the fuel after separation by permeation. When the temperature of the lubricating oil is high (e.g., higher than 50° C.), oil is included in the fuel after separation by permeation.

The gas component of the fuel centrifugally separated by the vapor-liquid separator 23 is temporarily collected by a canister 30 via a path 29. Then, the gas component is introduced to an air intake pipe 36 at a proper timing and is burned. In addition, the liquid component of the fuel after centrifugal separation by the vapor-liquid separator 23 is returned to the oil pan 5 via the oil return path 81.

(3) An Effect of the Embodiment

According to the third embodiment, functions and effects substantially similar to those of the first embodiment can be achieved. In addition, the diluting fuel-in-oil treating apparatus 80 is further provided with the oil return path 81 so that the liquid component of the fuel including oil after vapor-liquid separation can be treated without returning the liquid component to the fuel tank 33.

The present invention is not limited to the first to third embodiments above and includes other embodiments with various modifications within the scope of the present invention according to the purpose and use thereof. In other words, although the centrifugal vapor-liquid separator 23 is mentioned as an example in the first to third embodiments, the present invention is not limited to the same, and, for example, a chamber type vapor-liquid separator provided with a main body having a separation chamber partitioned into a plurality of spaces by a partition wall may be used, the chamber type vapor-liquid separator separating the fuel introduced into the separation chamber of the main body into the gas component and the liquid component by causing the fuel to collide with the partition wall to enable the fuel to flow.

Although the canister 30 having a granular activated carbon filled therein is mentioned as an example of a fuel collector in the first to third embodiments, the present invention is not limited to the same, and, for example, a canister configured of an activated carbon honeycomb structure may be used.

Figure 6:
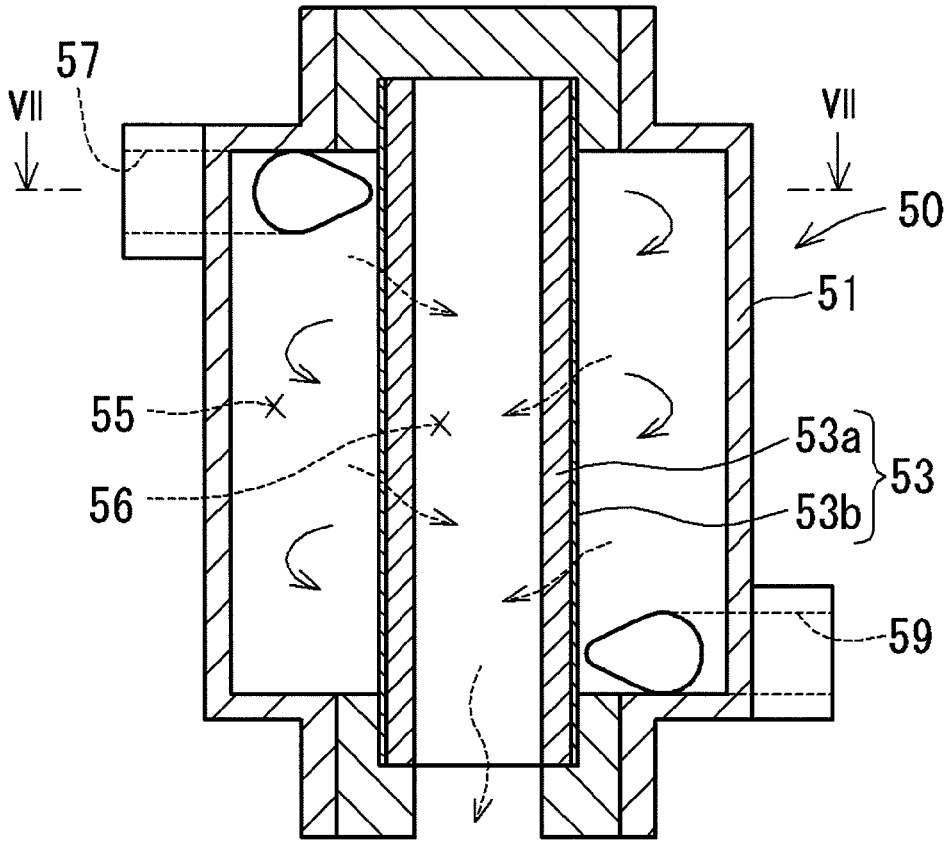
FIG. 6 is a cross-sectional view of a fuel separator according to an alternative embodiment.
Figure 7:
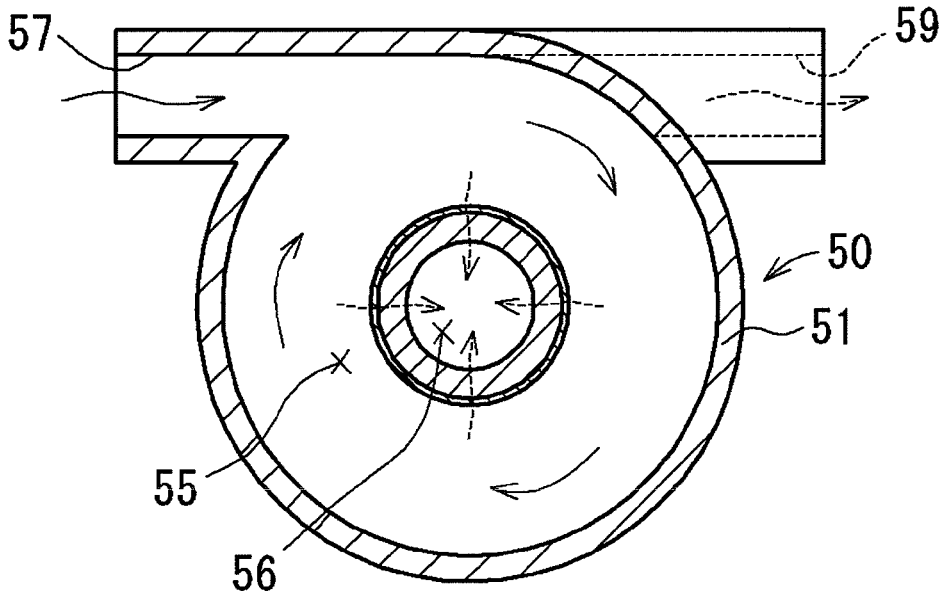
FIG. 7 is a cross-sectional view of the fuel separator taken along a line VII-VII in FIG. 6.

The fuel separator 10 is mentioned as an example in the first to third embodiments, the fuel separator 10 having the first region 15 which is the inner side of the ceramic filter 13 and the second region 16 which is the external region of the ceramic filter 13. The present invention is not limited to the same, however, and, as shown in FIG. 6 and FIG. 7, a fuel separator 50 may be used, for example, the fuel separator 50 having a first region 55 which is an external region of a ceramic filter 53 and a second region 56 which is an inner region of the ceramic filter 53. In this case, it is preferable that a separator main body 51 is provided with an oil inlet 57 for introducing lubricating oil in the direction tangential to the separator main body 51. The reason for this is to add a turning force to the oil in the first region 55, and the turn can cause foreign objects such as metal powder having a large relative density in the oil to be collected in the centrifugal direction of the separator main body 51. In addition, it is preferable that the separator main body 51 is provided with an oil discharger 59 for discharging lubricating oil in the direction tangential to the separator main body 51. The reason for this is to add a stronger turning force to the oil in the first region 55.

Figure 8:
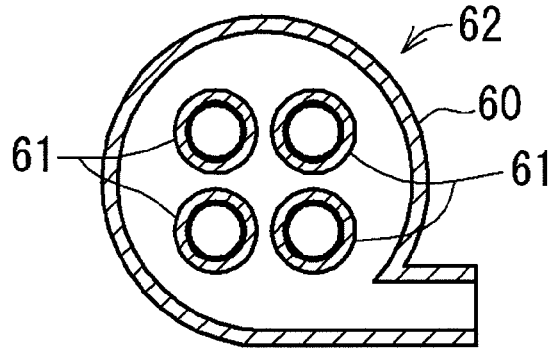
FIG. 8 is a longitudinal sectional view of a fuel separator according to an alternative embodiment.

Although the fuel separator 10 having one ceramic filter 13 in the separator main body 11 thereof is mentioned as an example in the first to third embodiments, the present invention is not limited to the same, and, as shown FIG. 8, a fuel separator 62 provided with a plurality of ceramic filters 61 (four pieces in the drawing) in a separator main body 60 may be used, for example.

Figure 9:
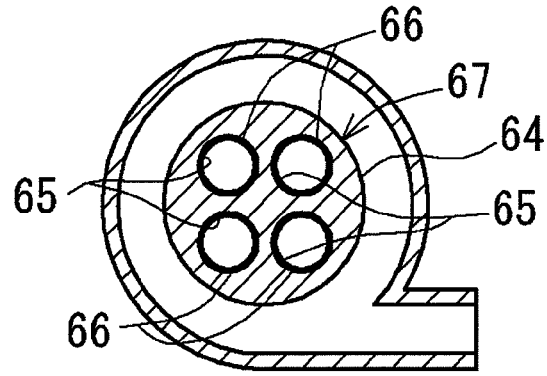
FIG. 9 is a longitudinal sectional view of a ceramic filter according to an alternative embodiment.

Although the ceramic filter 13 in which the separation membrane 13*b* having a cylindrical shape is supported at the inner peripheral side of the support body 13*a* having a cylindrical shape is mentioned as an example in the first to third embodiments, the present invention is not limited to the same, and, as shown in FIG. 9, a ceramic filter 67 in which a separation membrane 66 is supported in each of plurality of through holes 65 provided in a support body 64 having a columnar shape may be used, for example.

Although the ceramic filter 13 having a tubular shape partitions the interior of the separator main body 11 into the first region 15 and the second region 16 in the first to third embodiments, the present invention is not limited to the same, and, for example, a planar separation member may be used to partition the interior of the separator main body 11 into the first region and the second region that are adjacent to each other in the right and left direction.

Although the fuel separator 10 is provided on the downstream side of the oil pump 8 of the oil path 7 in the second and third embodiments, the present invention is not limited to the same, and, for example, the fuel separator 10 may be provided on the upstream side of the oil pump 8 of the oil path 7.

Although the open/close valve 20 that opens and closes based on the pressure of the lubricating oil is mentioned as an example in the first embodiment, the present invention is not limited to the same, and, for example, a thermostat valve that opens and closes based on the temperature of the lubricating oil may be employed. In addition, a solenoid valve may be employed, the solenoid valve being controlled to open or close based on the detection result of a detection sensor that detects any combination of one or more of: the temperature, the pressure, the viscosity, and the fuel dilution of the lubricating oil, the temperature of the cooling water that cools the lubricating oil, the temperature of the components of the internal combustion engine, and so on.

Figure 10:
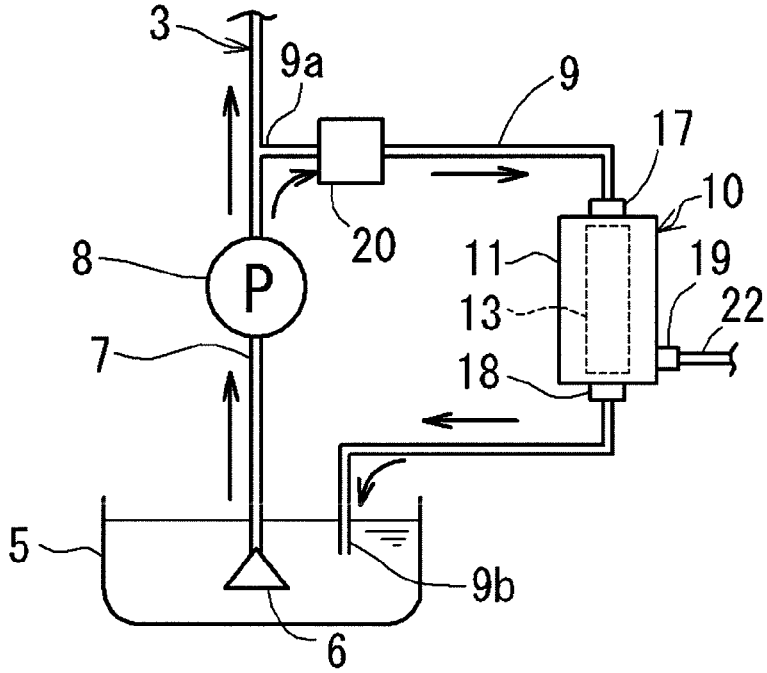
FIG. 10 is a partial circuit diagram schematically illustrating a diluting fuel-in-oil treating apparatus according to an alternative embodiment.

Although the bypass path 9 has the other end side 9*b* (the outlet end side) thereof connected to the upstream side of the oil pump 8 of the oil path 7 in the first embodiment, the present invention is not limited to the same, and, as shown in FIG. 10, the other end side 9*b* (the outlet end side) of the bypass path 9 may be connected into the oil pan 5, for example. In this case, the lubricating oil is returned to the oil pan 5 after the fuel was separated therefrom and is mixed into a large amount of the lubricating oil in the oil pan 5 from which the fuel has not yet been separated. Thereby, the lubricating oil including a relatively large amount of the fuel component flows in the oil path 7, improving the fuel separation efficiency.

Although a viscosity sensor is mentioned in the second embodiment as an example of the oil sensor 74, the present invention is not limited to the same, and, for example, a dilution sensor or a concentration sensor may be employed for the oil sensor.

Although the oil sensor 74 is provided on the upstream side of the solenoid valve 73 of the fuel return path 71 in the second embodiment, the present invention is not limited to the same, and, for example, the oil sensor 74 may be provided midway through the path 22 connecting the fuel separator 10 and the vapor-liquid separator 23.

Although one end side of the branch path 72 is connected to the oil pan 5 in the second embodiment, the present invention is not limited to the same, and, for example, one end side of branch path 72 may be connected to the oil path 7.

Although one end side of the oil return path 81 is connected to the oil pan 5 in the third embodiment, the present invention is not limited to the same, and, for example, one end side of the oil return path 81 may be connected to the oil path 7.

In addition, in the diluting fuel-in-oil treating apparatus 1 of the first embodiment, when the setting value of the pressure of the lubricating oil based on which the open/close valve 20 operates is relatively low (specifically, when the setting value of the temperature of the lubricating oil is relatively high (e.g., higher than 50° C.)), the fuel after separation by permeation by the fuel separator 20 includes oil. Therefore, the fuel return path 71, the branch path 72, the solenoid valve 73, and the oil sensor 74 according to the second embodiment may further be provided instead of the fuel return path 32. In addition, the oil return path 81 according to the third embodiment may be provided instead of the fuel return path 32.

The present invention may widely be utilized as a technology for separating and treating the diluting fuel in the lubricating oil of an internal combustion engine. Particularly, the present invention may suitably be utilized as a technology for separating and treating the diluting fuel in the lubricating oil of a fuel injection engine.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A diluting fuel-in-oil treating apparatus of an internal combustion engine comprising:

a cross-flow filtration fuel separator having a separation membrane that separates by permeation, fuel from lubricating oil flowing in an oil circuit of the internal combustion engine;

a vapor-liquid separator that separates the fuel separated by the cross-flow filtration fuel separator into a gas component and a liquid component;

a fuel collector that collects the gas component of the fuel separated by the vapor-liquid separator;

an oil path that connects an oil container to a lubricated part of the internal combustion engine and constituting the oil circuit, a portion of the lubricating oil from the oil path being dischargeable to the cross-flow filtration fuel separator; and a path that connects the fuel collector to a downstream side of a throttle valve of an air intake pipe of the internal combustion engine such that the collected gas component of the fuel collector is introducible into the air intake pipe.

2. The diluting fuel-in-oil treating apparatus of the internal combustion engine according to claim 1, further comprising:

a fuel return path that connects a liquid component discharger of the vapor-liquid separator to a fuel tank.

3. The diluting fuel-in-oil treating apparatus of the internal combustion engine according to claim 2, further comprising:

an oil pump provided in the oil path and configured to supply lubricating oil from the oil container to the lubricated part;

a bypass path having one end connected to a downstream side of the oil pump in the oil path and another end connected to an upstream side of the oil pump in the oil path and further comprising the cross-flow filtration fuel separator; and an open/close valve provided in the bypass path, the open/close valve configured to open and close the bypass path based on a temperature of the lubricating oil or a physical quantity of the lubricating oil having a correlation with the temperature.

4. The diluting fuel-in-oil treating apparatus of the internal combustion engine according to claim 1, further comprising:

an oil sensor configured to detect the lubricating oil in the fuel separated by the crossflow filtration fuel separator;

a fuel return path that connects a liquid component discharger of the vapor-liquid separator to a fuel tank;

a branch path that branches from the fuel return path and connects to an oil container; and a solenoid valve provided at a branch portion where the branch path branches from the fuel return path, the solenoid valve configured to switch between an opening and a closing of the branch path and the fuel return path based on a detection result of the oil sensor.

5. The diluting fuel-in-oil treating apparatus of the internal combustion engine according to claim 4, wherein the oil sensor is provided on an upstream side of the branch portion where the branch path branches from the fuel return path.

6. The diluting fuel-in-oil treating apparatus of the internal combustion engine according to claim 1, further comprising an oil return path that connects a liquid component discharger of the vapor-liquid separator to an oil container.

7. The diluting fuel-in-oil treating apparatus of the internal combustion engine according to claim 1, wherein the cross-flow filtration fuel separator includes a separator main body having a generally tubular shape and a separation member having the separation membrane, wherein the separation member is provided inside the separator main body and partitions the interior of the separator main body into a first region and a second region; and wherein the separator main body includes an oil inlet configured to introduce lubricating oil in the first region, an oil discharger configured to discharge the lubricating oil from the first region, and a fuel discharger configured to discharge the fuel from the second region.

8. The diluting fuel-in-oil treating apparatus of the internal combustion engine according to claim 4, wherein the separation member is generally tubular and has an axis extending along a direction of an axis of the separator main body.

9. The diluting fuel-in-oil treating apparatus of the internal combustion engine according to claim 5, wherein the oil inlet is configured to introduce the lubricating oil in a direction tangential to the separator main body.

10. The diluting fuel-in-oil treating apparatus of the internal combustion engine according to claim 4, wherein the separation member comprises:

the separation membrane having a tubular shape and a plurality of fuel-component permeable fine pores; and a support body configured to support the separation membrane and including a plurality of fine pores, wherein the diameters of the plurality of fine pores of the support body are larger than the plurality of fuel-component permeable fine pores of the separation membrane.

11. The diluting fuel-in-oil treating apparatus of the internal combustion engine according to claim 1, wherein the vapor-liquid separator is connected to the fuel collector via a gas component discharge path.

12. The diluting fuel-in-oil treating apparatus of the internal combustion engine according to claim 1, wherein the fuel collector includes a canister having an adsorbent.

* * * * *